US006923219B2

(12) United States Patent
Shteiyer

(10) Patent No.: US 6,923,219 B2
(45) Date of Patent: Aug. 2, 2005

(54) DOUBLE-SIDED FABRIC: FLAT SIDE / WOVEN PILE FABRIC

(75) Inventor: Yaakov Shteiyer, West Orange, NJ (US)

(73) Assignee: J.B. Martin Company, Inc., New York, NY (US)

( * ) Notice: Subject to any disclaimer, the term of this patent is extended or adjusted under 35 U.S.C. 154(b) by 312 days.

(21) Appl. No.: 10/412,722

(22) Filed: Apr. 11, 2003

(65) Prior Publication Data

US 2004/0200539 A1 Oct. 14, 2004

(51) Int. Cl.[7] ..... D03D 27/00
(52) U.S. Cl. ..... 139/397; 139/394; 139/398
(58) Field of Search ..... 139/394, 397, 139/398, 391, 392, 402, 403, 404, 405, 407, 408

(56) References Cited

U.S. PATENT DOCUMENTS

| | | | | | |
|---|---|---|---|---|---|
| 484,541 | A | | 10/1892 | Pearson | |
| 1,096,510 | A | | 5/1914 | Doux | |
| 1,143,804 | A | | 6/1915 | Binz | |
| 1,778,196 | A | | 10/1930 | Nutter | |
| 1,795,157 | A | | 3/1931 | Zimmermann, Jr. | |
| 2,108,046 | A | * | 2/1938 | Drobile | 139/397 |
| 2,235,732 | A | * | 3/1941 | Sudell | 139/391 |
| 2,297,708 | A | | 10/1942 | Kaufman | |
| 2,306,390 | A | * | 12/1942 | Kaufman | 139/397 |
| 2,329,739 | A | | 9/1943 | Baker | |
| 2,333,258 | A | * | 11/1943 | Lambert | 28/159 |
| 2,866,255 | A | * | 12/1958 | Keen | 428/89 |
| 3,204,669 | A | * | 9/1965 | Valentine | 139/46 |
| 3,289,706 | A | * | 12/1966 | Valentine | 139/21 |
| 3,499,471 | A | | 3/1970 | Kuny | |
| 3,865,678 | A | * | 2/1975 | Okamoto et al. | 428/91 |
| 4,456,035 | A | * | 6/1984 | Bruggemann et al. | 139/398 |
| 4,773,135 | A | * | 9/1988 | Sato et al. | 28/160 |
| 5,400,831 | A | | 3/1995 | Gheysen | |
| 5,465,761 | A | * | 11/1995 | Gheysen | 139/21 |
| 5,655,573 | A | | 8/1997 | Gheysen et al. | |
| 6,092,562 | A | | 7/2000 | Debaes | |
| 6,095,198 | A | | 8/2000 | Debaes | |
| 6,123,117 | A | * | 9/2000 | Borellini | 139/420 A |
| 6,182,708 | B1 | | 2/2001 | Smissaert | |
| 6,457,489 | B2 | | 10/2002 | Smissaert | |
| 6,823,900 | B2 | * | 11/2004 | Wildeman et al. | 139/391 |

* cited by examiner

*Primary Examiner*—John J. Calvert
*Assistant Examiner*—Robert H. Muromoto, Jr.
(74) *Attorney, Agent, or Firm*—Alston & Bird LLP

(57) ABSTRACT

A pile fabric includes woven together inner and outer layers and cut pile yarns woven into the inner layer. The outer layer has a higher yarn count than the inner layer, without counting the pile yarns. The pile fabric is one of two substantially similar pile fabrics formed by simultaneously weaving two fabrics that are connected to one another by the pile yarns, and then cutting the pile yarns to separate the pile fabrics from one another. Nonpile surfaces of each of the connected fabrics include an oblique, woven fabric pattern. The fabric pattern of a first of the connected fabrics is at least substantially like the fabric pattern of the second of connected fabrics, except that the fabric pattern of the first connected fabric is not parallel to the fabric pattern of the second connected fabric.

23 Claims, 9 Drawing Sheets

DOUBLE-SIDED FABRIC: FLAT SIDE / WOVEN PILE FABRIC

BACKGROUND OF THE INVENTION

The present invention relates to flat and pile fabrics and, more particularly, to woven flat and pile fabrics.

It is well known to form pile fabrics by simultaneously weaving two fabrics that are connected to one another by pile yarns, and then cutting the pile yarns to separate the pile fabrics from one another. Although pile fabrics are well known, there is always a desire for improvements.

BRIEF SUMMARY OF THE INVENTION

One aspect of the present invention relates to a pile fabric that includes woven together inner and outer layers and cut pile yarns woven into the inner layer, with the pile yarns preferably not extending into the outer layer. The outer layer at least partially defines a nonpile surface of the pile fabric. Preferably the nonpile surface can be a wide variety of different types of surfaces other than pile surfaces, such as, but not limited to, a substantially flat surface, or the like. The pile yarns extend away from the outer layer and protrude from the inner layer so that the pile yarns define a pile surface of the pile fabric. The inner layer is positioned between (e.g., sandwiched between) the outer layer and the portions of the pile yarns that protrude from the inner layer; preferably the inner layer is at least substantially hidden from view.

Preferably the fabric is reversible, meaning that either the nonpile surface of the fabric or the pile surface of the fabric can be an exposed (e.g., outer) surface of a garment or other textile article made from the fabric. That is and preferably, in the end use of the fabric, such as when the fabric is formed into a garment, either the nonpile surface of the fabric or the pile surface of the fabric can be an "inner" surface of the garment which is for facing the body of the person wearing the garment. In some applications it is preferred for the pile surface of the fabric to be the inner surface of the garment, so that the pile surface of the fabric faces the body of the person wearing the garment. Notwithstanding the foregoing, the fabric of the present invention can be used in place of many different types of known fabrics and in many different configurations.

In accordance with one aspect of the present invention, the outer layer preferably has a higher yarn count than the inner layer, without counting the pile yarns. More specifically, the outer layer has a larger number of warp yarns per inch than the inner layer, and/or the outer layer has a larger number of weft yarns per inch than the inner layer, without counting the pile yarns. As a result, the outer layer can be very dense without requiring the inner layer to be very dense. Accordingly, the advantages of having a dense outer layer can be achieved without having to also have a correspondingly dense inner layer, so that the amount of yarn included in the inner layer can be reduced, if desired, to control/reduce the cost of the fabric. Advantages of having a dense outer layer include or relate to, for example, wind resistance, capability of printing on without "bleed-through," embossing, fire proofing, outdoor uses such as hunting, technical fabrics, and uniform fabrics, etc.

In accordance with one aspect of the present invention, the weft yarns of the inner layer interlace with the warp yarns of the outer layer so that the outer and inner layers are connected to one another, and so that the weft yarns of the inner layer at least partially define the nonpile surface.

Having the weft yarns of the inner layer at least partially define the nonpile surface advantageously contributes to a relatively high yarn count at the nonpile surface, and it also advantageously allows the weft yarns of the inner layer to contribute to any woven pattern at the nonpile surface.

In accordance with one aspect of the present invention, the pile fabric is one of two substantially similar pile fabrics. In accordance with this aspect, the pile fabrics are formed by simultaneously weaving two fabrics that are connected to one another by the pile yarns, and then cutting the pile yarns to separate the pile fabrics from one another.

According to one aspect of the present invention, the connected fabrics are simultaneously woven so that the nonpile surface of each of upper and lower connected fabrics includes a woven fabric pattern. In accordance with this aspect, the woven fabric patterns extend obliquely with respect to the longitudinal/lengthwise directions of the fabrics. The fabric pattern of the upper connected fabric is at least substantially like the fabric pattern of the lower connected fabric, yet the fabric pattern of the upper connected fabric is not parallel to, and most preferably it is perpendicular to, the fabric pattern of the lower connected fabric, while the connected fabrics are connected to one another. Further in accordance with this aspect, after the pile yarns joining the upper and lower connected fabrics are cut, the respectively resulting upper and lower pile fabrics can be configured in a predetermined overlapping configuration so that simultaneously: the upper and lower pile fabrics are at least about parallel, the pile surface of the upper pile fabric is in opposing face-to-face relation with the nonpile surface of the lower pile fabric, and the patterns of the upper and lower pile fabrics are at least substantially parallel, and preferably aligned.

It is possible to simultaneously cut through both of the pile fabrics according to a predetermined cutting pattern while they are in the predetermined overlapping configuration. It is advantageous that the fabric patterns can be substantially parallel and aligned while the pile surface of the upper pile fabric is in opposing face-to-face relation with the nonpile surface of the lower pile fabric, because both fabric patterns can conveniently be simultaneously seen for alignment purposes, and because it is advantageous in some situations to have fabric patterns parallel and aligned when simultaneously cutting through multiple fabrics according to a cutting pattern.

BRIEF DESCRIPTION OF THE DRAWINGS

Figure 1:
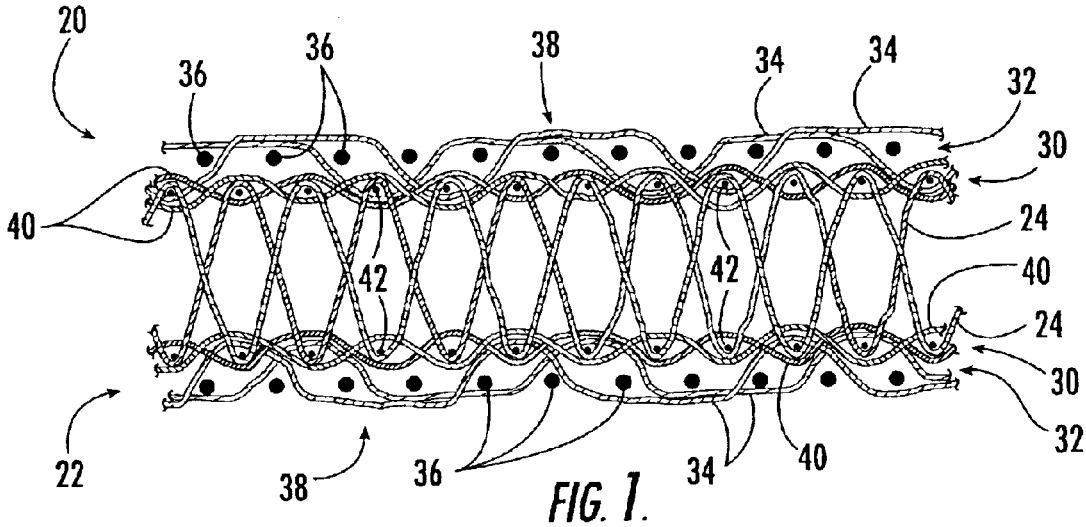
Figure 2:
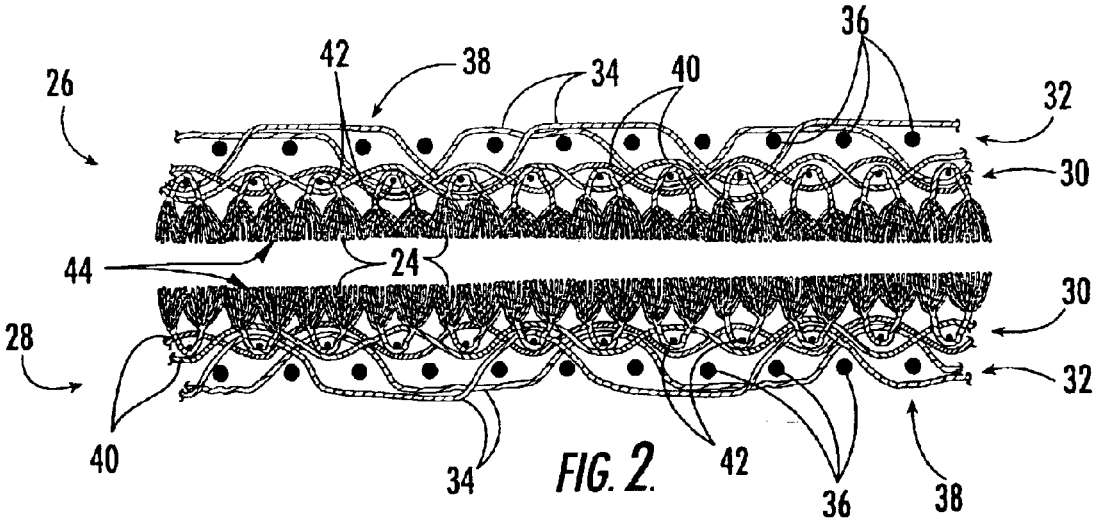
Figure 3:
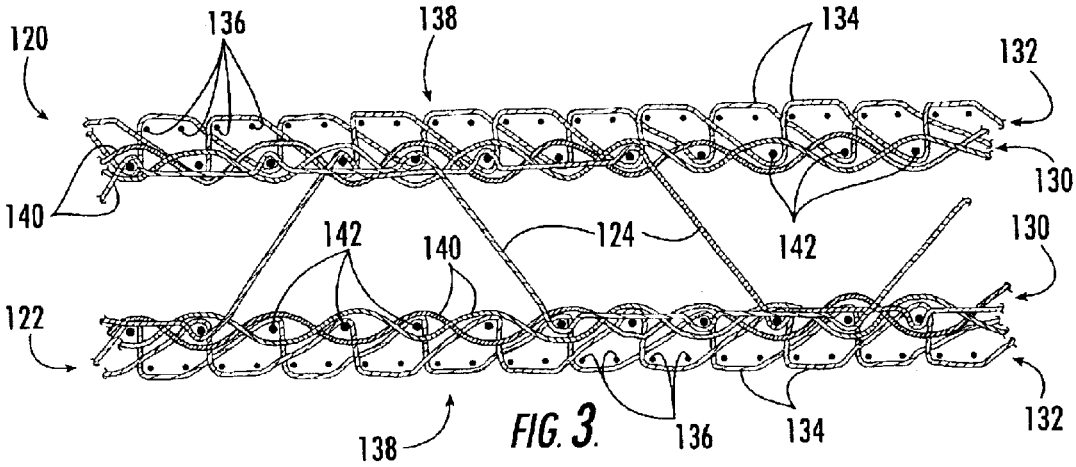
Figure 4:
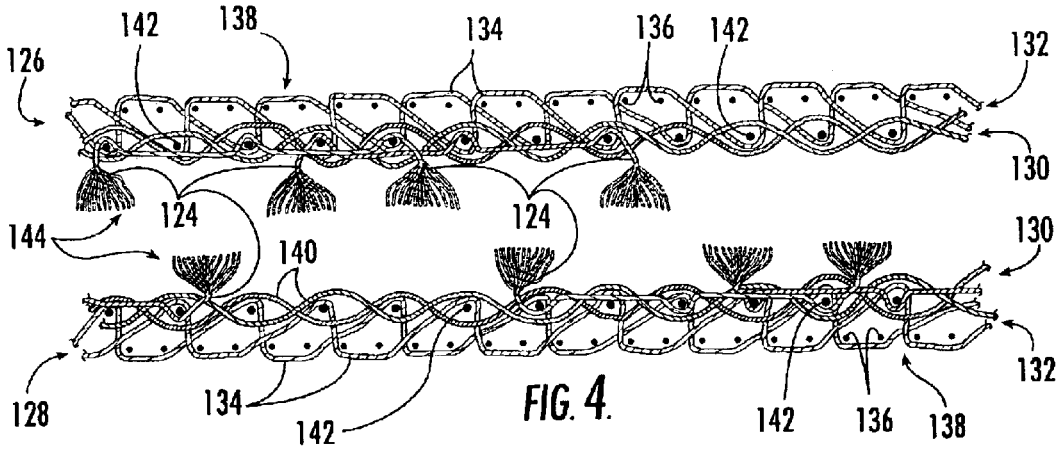
Figure 5:
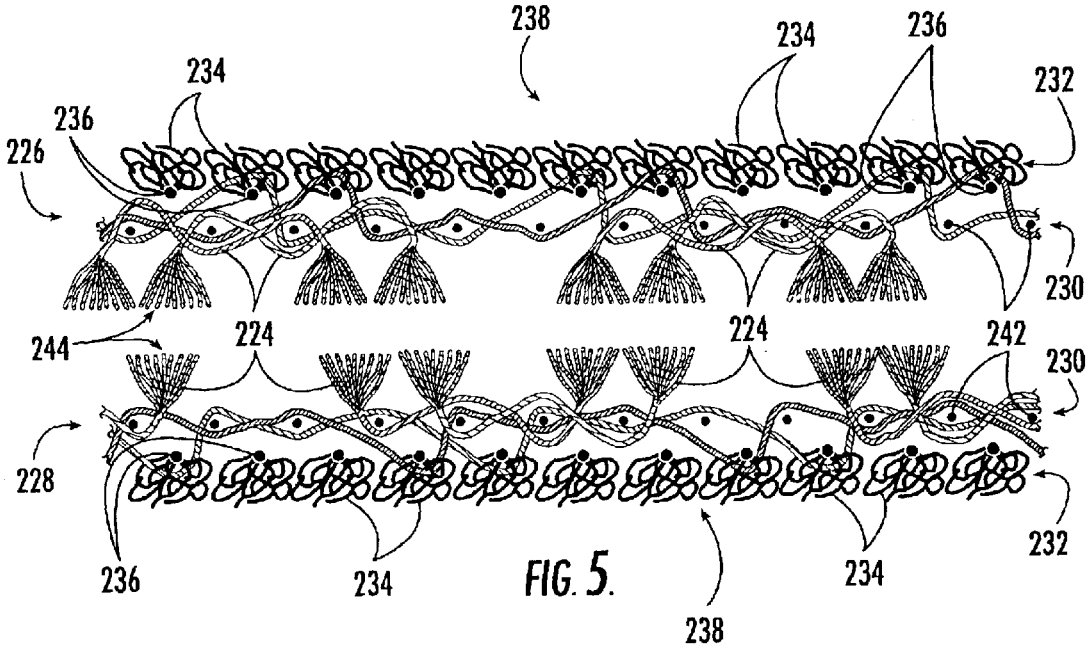
Figure 6:
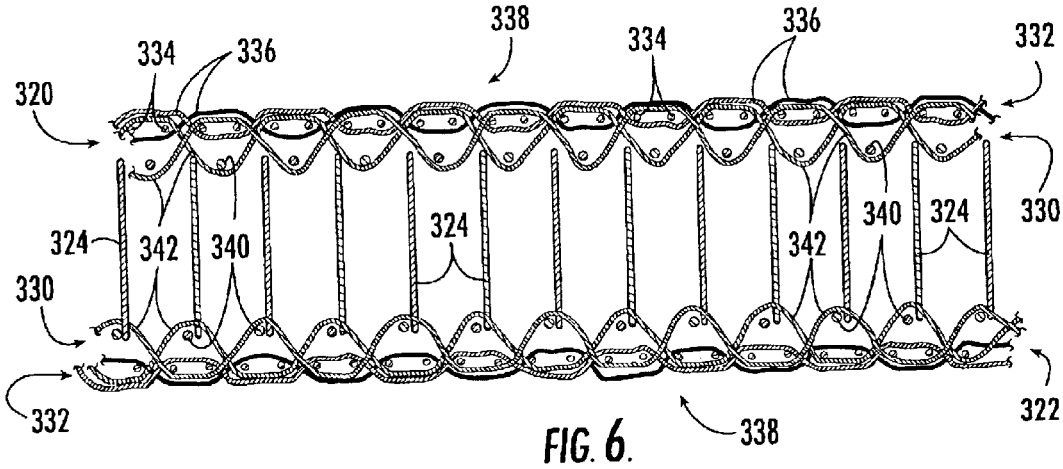
Figure 7:
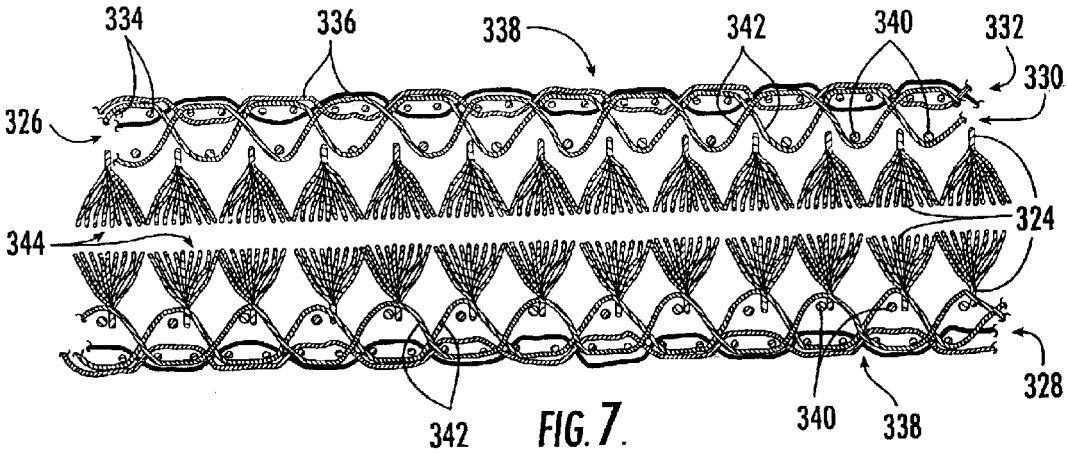
Figure 8:
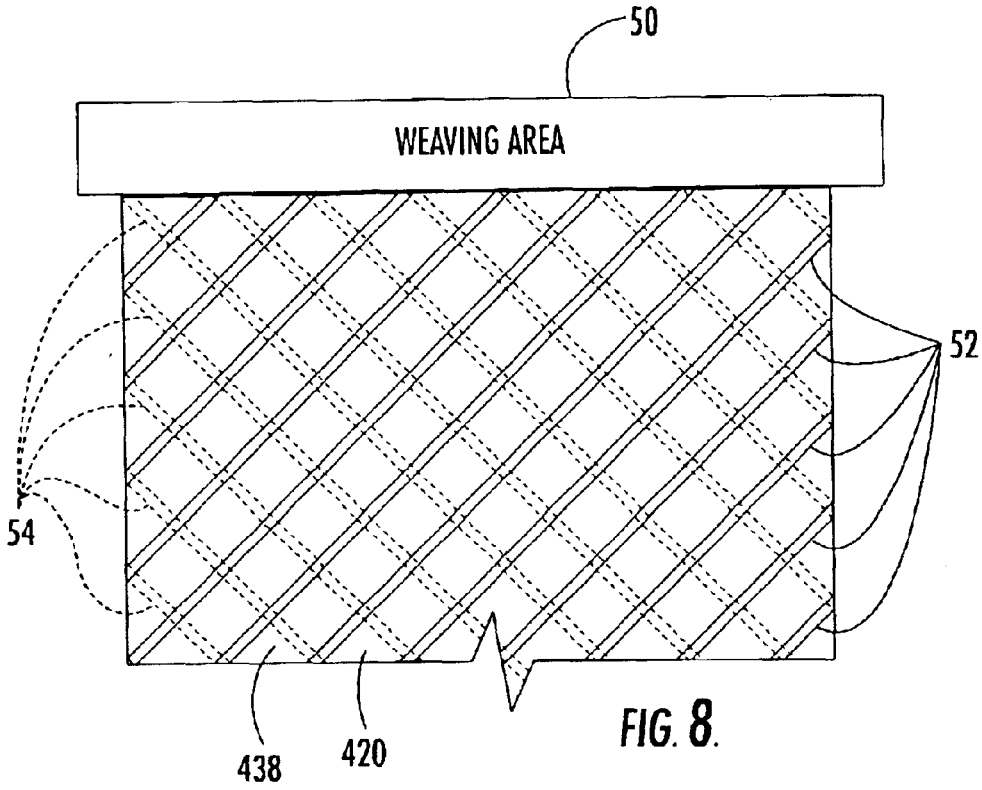
Figure 9:
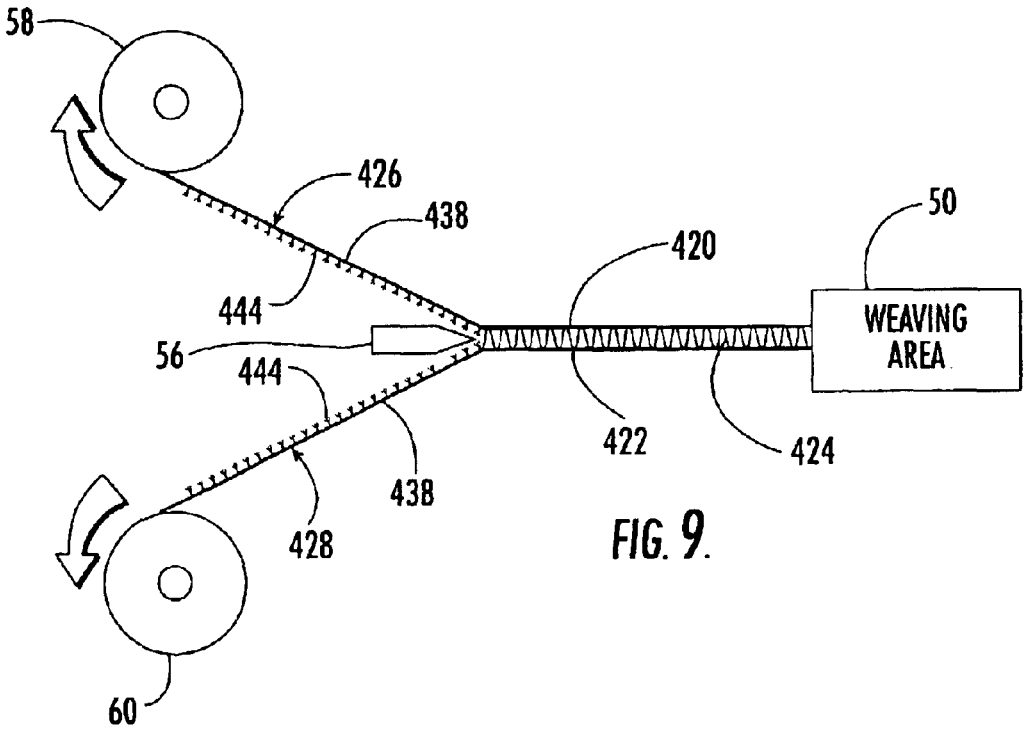
Figure 10:
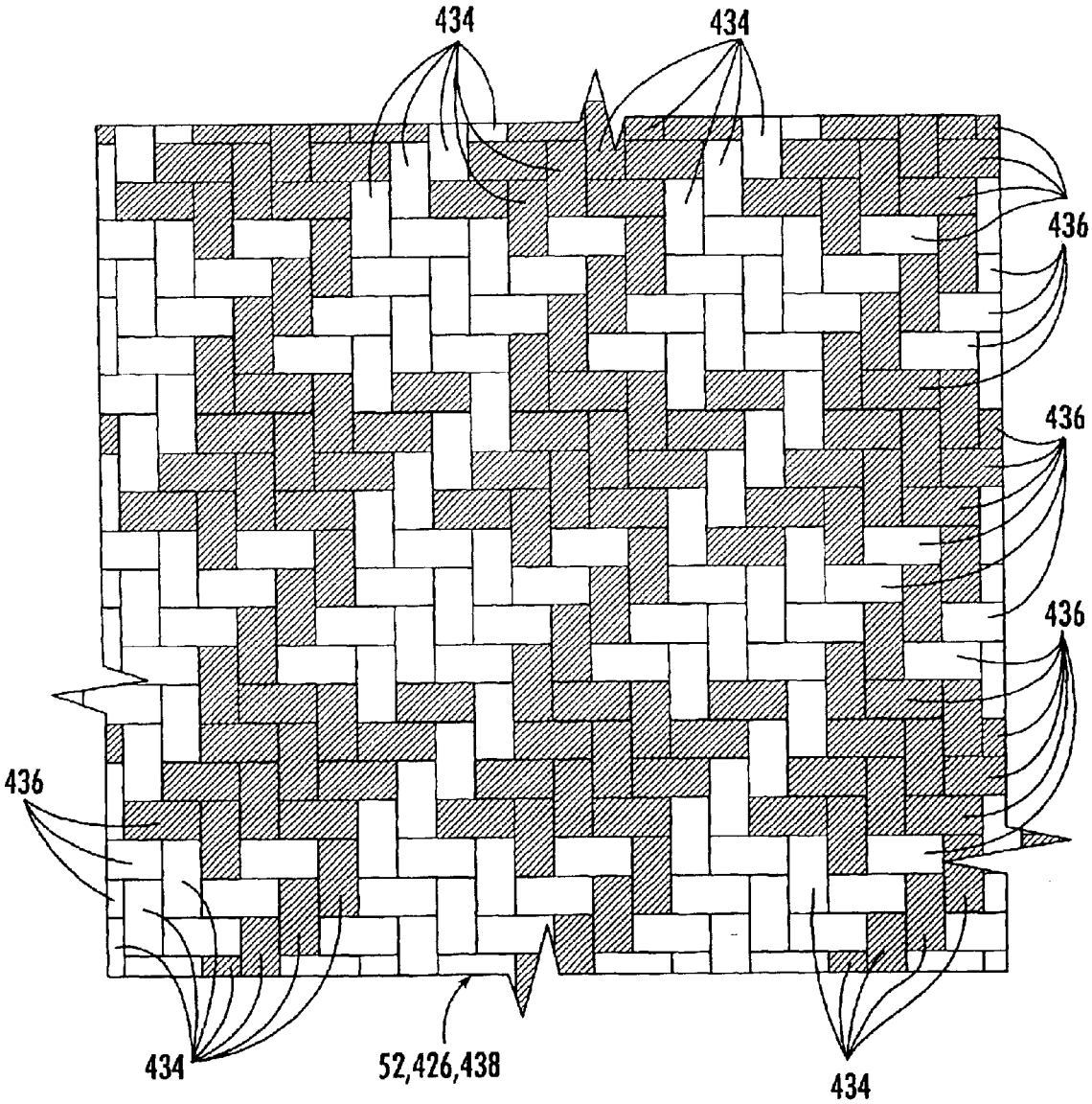
Figure 11:
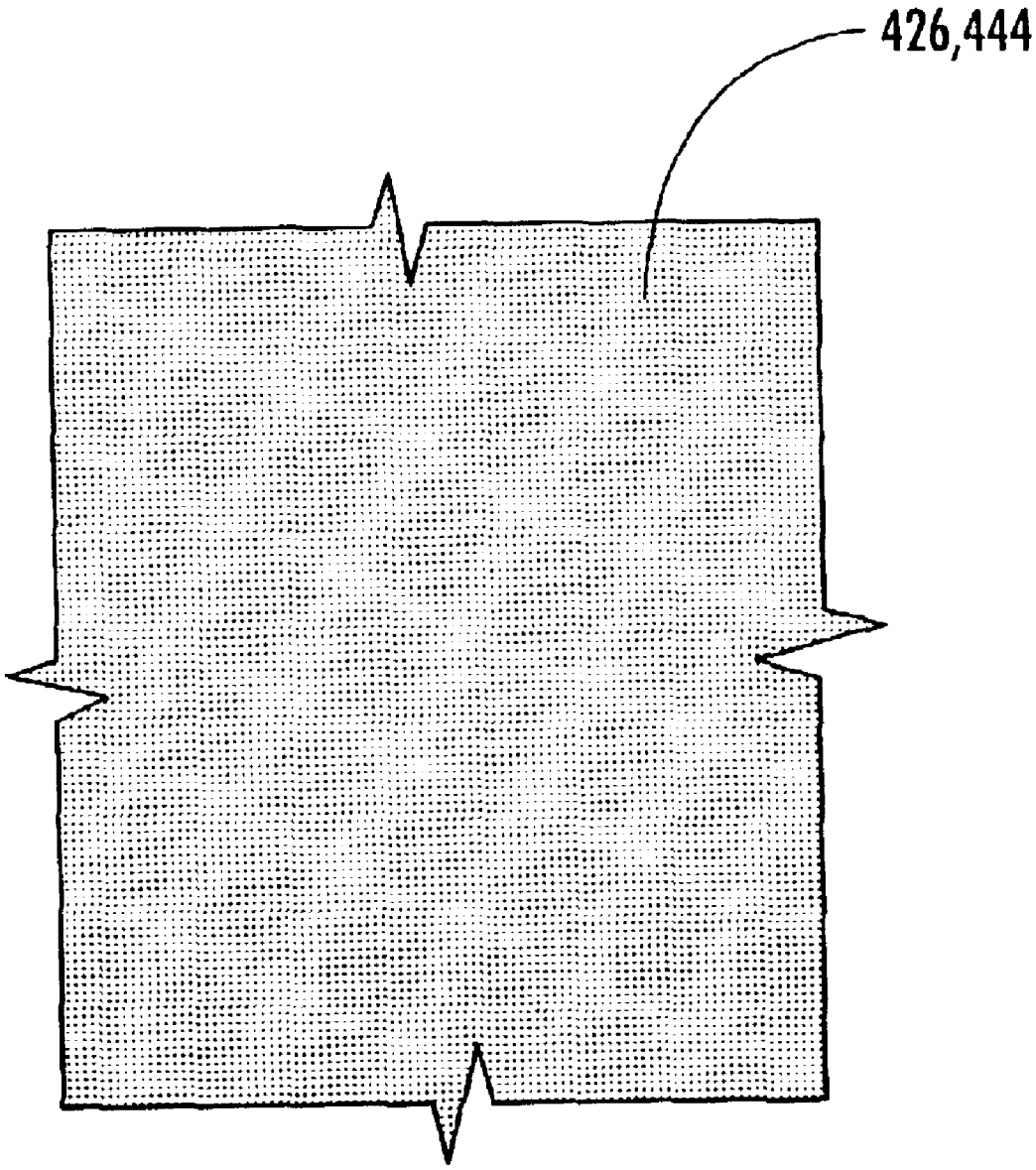
Figure 12:
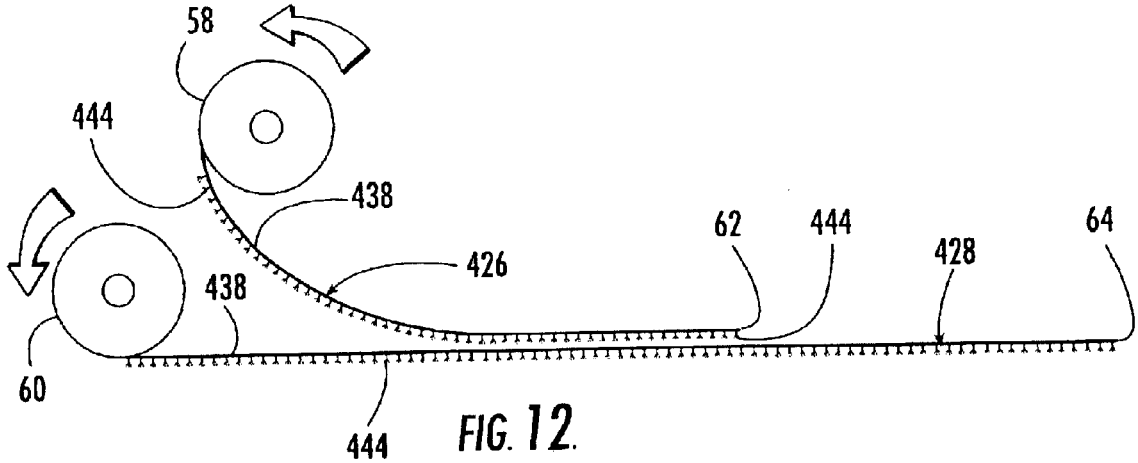
Figure 13:
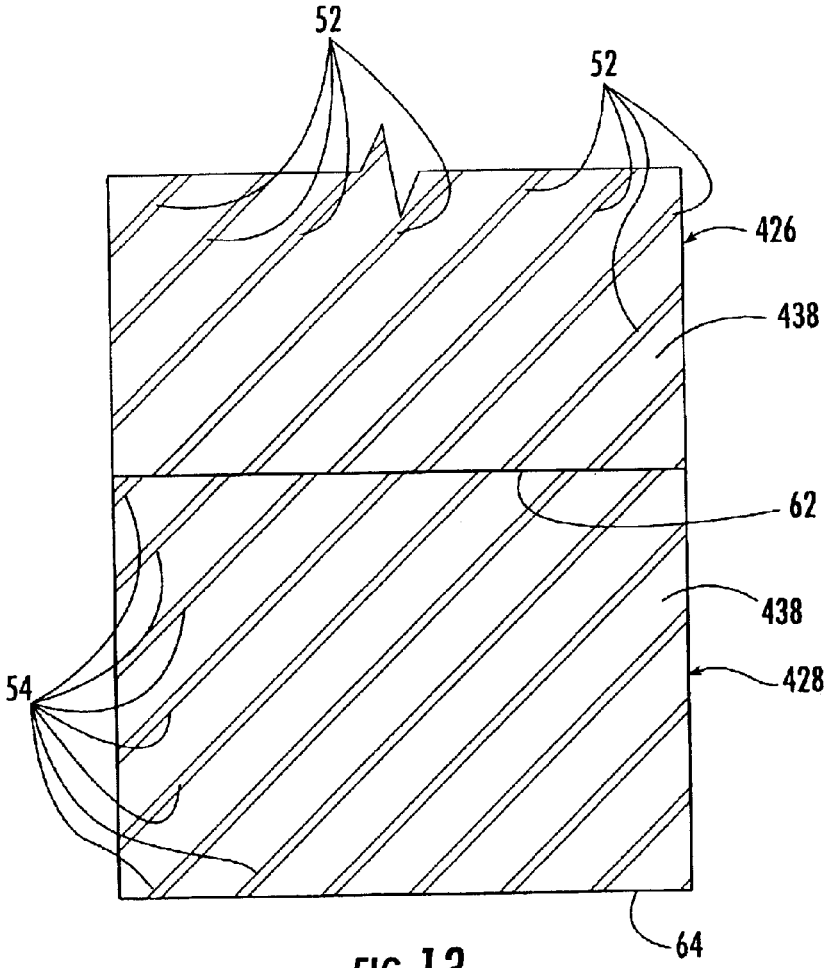
Figure 14:
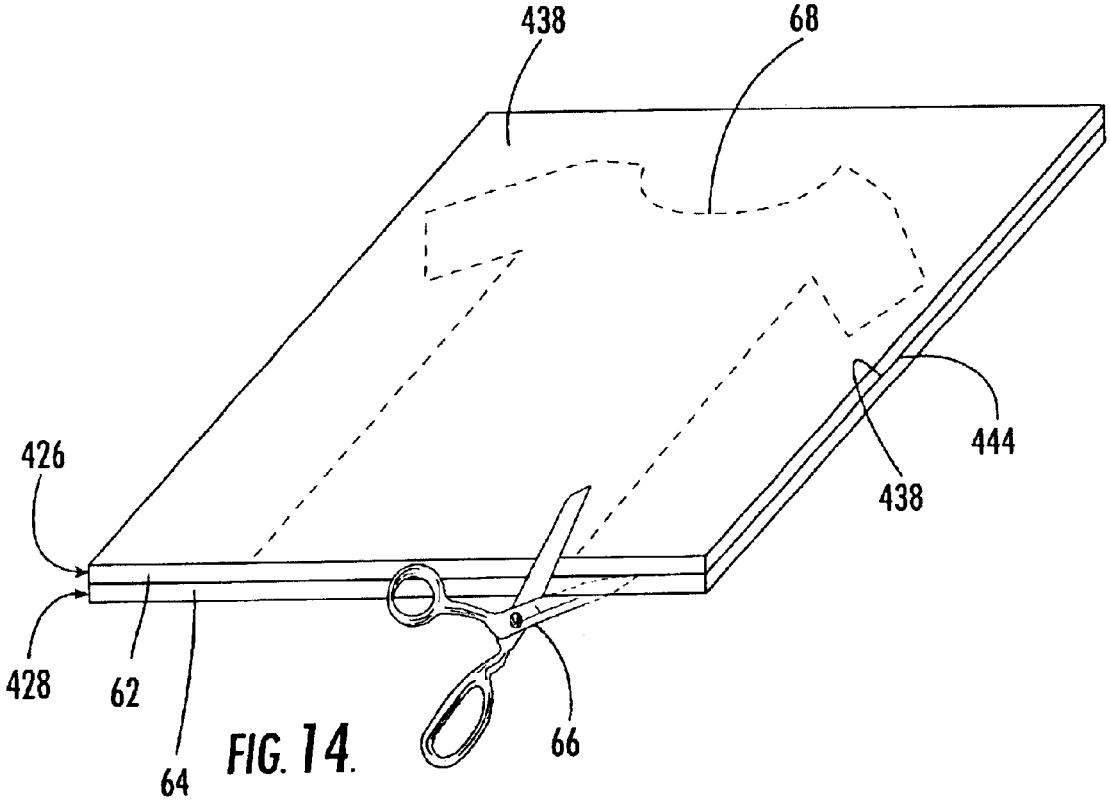

Having thus described the invention in general terms, reference will now be made to the accompanying drawings, which are not necessarily drawn to scale, and wherein:

FIG. 1 is a schematic elevational view of longitudinal edges of connected fabrics woven face-to-face with pile yarns interchanging therebetween, in accordance with a first embodiment of the present invention;

FIG. 2 is a schematic elevational view of longitudinal edges of pile fabrics that were formed by cutting, combing and shearing the pile yarns of FIG. 1 (to form velvet), in accordance with the first embodiment of the present invention;

FIG. 3 is a schematic elevational view of longitudinal edges of connected fabrics woven face-to-face with pile yarns interchanging therebetween, in accordance with a second embodiment of the present invention;

FIG. 4 is a schematic elevational view of longitudinal edges of pile fabrics that were formed by cutting, combing and shearing the pile yarns of FIG. 3 (to form velvet), in accordance with the second embodiment of the present invention;

FIG. 5 is a schematic elevational view of longitudinal edges of pile fabrics that were formed by cutting, combing and shearing pile yarns (to form velvet) that were connecting connected fabrics that were woven face-to-face with the pile yarns interchanging therebetween, and for each fabric, the side opposite the velvet has been napped (i.e., the nonpile surface has been napped) to form fleece, in accordance with a third embodiment of the present invention;

FIG. 6 is a schematic elevational view of lateral edges of connected fabrics woven face-to-face with pile yarns interchanging therebetween, in accordance with a fourth embodiment of the present invention;

FIG. 7 is a schematic elevational view of lateral edges of pile fabrics that were formed by cutting, combing and shearing the pile yarns of FIG. 6 (to form velvet), in accordance with the fourth embodiment of the present invention;

FIG. 8 is a schematic top plan view of a portion of connected fabrics, which were woven face-to-face with pile yarns interchanging therebetween, as they exit the weaving area of the loom, with nonpile outer surfaces of the connected fabrics including woven fabric patterns that are respectively illustrated by solid and broken lines, in accordance with a fifth embodiment of the present invention;

FIG. 9 is a schematic side elevational view of the weaving area of the loom and fabrics of FIG. 8, with the fabrics being split and wound into rolls, in accordance with the fifth embodiment of the present invention;

FIG. 10 is a schematic plan view of a portion of the nonpile surface of one of the fabrics of FIG. 8, and a schematic plan view of a portion of the nonpile surface of the other of the fabrics of FIG. 8 is identical, in accordance with the fifth embodiment of the present invention;

FIG. 11 is a schematic plan view of the pile surface of one of the pile fabrics of FIG. 9, and a schematic plan view of the pile surface of the other of the pile fabrics of FIG. 9 is identical, in accordance with the fifth embodiment of the present invention;

FIG. 12 is a schematic side elevational view of the pile fabrics of FIG. 9 being unrolled one on top of the other, in accordance with the fifth embodiment of the present invention;

FIG. 13 is a schematic, partial, top plan view of the arrangement of FIG. 12; and FIG. 14 is a schematic view illustrating a cutting pattern for the fabrics of FIG. 9 while they are one on top of the other, in accordance with the fifth embodiment of the present invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 schematically illustrates upper and lower connected fabrics 20, 22 woven face-to-face with pile yarns 24 interchanging therebetween, and FIG. 2 schematically illustrates upper and lower pile fabrics 26, 28 that were partially formed by cutting the pile yarns to separate the two fabrics, all in accordance with a first embodiment of the present invention. Throughout FIGS. 1–7, the cross-hatching is not used to indicate that yarns are cross-sectioned. Rather, the cross-hatching is used in an effort to distinguish yarns from one another, in an effort to clarify the figures. Likewise, only a representative few of the yarns are labeled with their reference numerals in FIGS. 1–7, in an effort to clarify the figures.

Referring to FIGS. 1 and 2, each of the fabrics 20, 22, 26, 28 includes an inner layer 30 and an outer layer 32. Each outer layer 32 includes warp yarns 34 and weft yarns 36 that are respectively woven together to at least partially define a nonpile surface 38 (e.g., a substantially flat surface) of the fabric. Each inner layer 30 includes warp yarns 40 and weft yarns 42 that are respectively woven together. The pile yarns 24 are tied into the inner layers 30, and the pile yarns preferably do not extend into the outer layers 32. As best understood with reference to FIG. 2, for each pile fabric 26, 28, the cut pile yarns 24 extend away from the outer layer 32 so that the pile yarns at least substantially define a pile surface 44 (e.g., a velvet surface) of the pile fabric. The pile yarns 24 of FIGS. 1 and 2 are tied into the inner layers 30 by a V-like weave. That is, V-like weaving of the pile yarns 24 secures them into the inner layers 30. As best understood with reference to FIG. 2, for the V-like weave, each cut pile yarn 24 extends from the pile surface 44, partially around/behind one weft yarn 42 of the inner layer 30, and then back to the pile surface.

Alternatively, the pile yarns 24 can be woven into the inner layers 30 by way of a U-like weave, a W-like weave (FIG. 5), or a multiple W-like weave (FIGS. 3 and 4), and other weaves are also within the scope of the present invention. Although these alternative weaves are not illustrated in FIG. 1 or 2, some of them will now be described with reference to a representative one of the inner layers 30 of FIG. 2. For the U-like weave, each cut pile yarn 24 extends from the pile surface 44, partially around/behind two adjacent weft yarns 42, and then back to the pile surface. For the W-like weave, each cut pile yarn 24 extends from the pile surface 44, partially around/behind a first weft yarn 42, partially around/over a second weft yarn 42 that is adjacent the first weft yarn 42, partially around/behind a third weft yarn 42 that is adjacent the second weft yarn 42, and then back to the pile surface. For the multiple W-like weave, each cut pile yarn 24 extends from the pile surface 44, partially around/behind a first weft yarn 42, partially around/over a second weft yarn 42 that is adjacent the first weft yarn 42, partially around/behind a third weft yarn 42 that is adjacent the second weft yarn 42, partially around/over a fourth weft yarn 42 that is adjacent the third weft yarn 42, partially around/behind a fifth weft yarn 42 that is adjacent the fourth weft yarn 42, and then back to the pile surface. Alternatively, for the multiple W-like weave, before a pile yarn 24 extends back to the pile surface 44, that pile yarn may respectively extend partially around/behind and partially around/over additional weft yarns 42. As compared to the V-like weave, a W-like weave can do a better job of securing the pile yarns 24, and the multiple W-like weave can do an even better job of securing the pile yarns. The multiple W-like weave of the pile yarns 24 can also reduce the amount of pile yarn used, which advantageously reduces cost.

In accordance with the first embodiment of the present invention, and for each fabric 20, 22, 26, 28, at least some of the yarns of at least one of the inner and outer layers 30, 32 interlace with at least some of the yarns of the other of the inner and outer layers 30, 32 so that the outer and inner layers are connected to one another. More specifically and as illustrated in FIGS. 1 and 2, for each fabric 20, 22, 26, 28, the warp yarns 34 of the outer layer 32 preferably extend into the inner layer 30 where they interlace with the weft yarns 42 of the inner layer 30 so that the outer and inner layers are connected to one another, and in some situations it is preferred that solely this technique be used for connecting the outer and inner layers to one another. As best understood with reference to FIG. 2, using solely the connecting technique mentioned in the immediately preceding sentence causes each connection between the outer and inner layers 32, 30 to preferably be in a place that is not visible at either of the nonpile and pile surfaces 38, 44. Likewise, and for each of the pile fabrics 26, 28, it is preferred for no part of the pile yarns 24 to be readily visible through the nonpile surface 38.

Referring to FIG. 2, and in accordance with the first embodiment of the present invention, each of the nonpile and pile surfaces 38, 44 is suitable for being an exposed surface of a garment or other textile article made from the pile fabrics 26, 28. That is and preferably, in the end use of the fabric, such as when the fabric is formed into a garment, either the nonpile surface 38 of the fabric or the pile surface 44 of the fabric can be an "inner" surface of the garment which is for facing the body of the person wearing the garment. Notwithstanding, it is preferred in many situations for a garment made from the pile fabrics of the present invention to be made or worn so that the pile surface 44 of the fabric faces the body of the person wearing the garment and the nonpile surface 38 of the fabric faces away from their body. Notwithstanding the foregoing, the fabrics of the present invention can be used in place of many different types of known fabrics and in many different configurations.

Also, various surface treatments are possible. For example, and as illustrated in FIG. 2, the pile surfaces 44 have been finished by combing the cut ends of the pile yarns 24 and shearing the combed pile to form a velvet-type of pile surface. Alternatively, the pile surfaces 44 can be used without combing and shearing or with other treatments. The nonpile surfaces 38 can be used without further processing such that they appear as a normal flat weave, or the like, or they can be napped (e.g., see FIG. 5) and sheared, or the like, so that they are in the form of velour (fleece), or the like. The nonpile and pile surfaces 38, 44 can be further processed in accordance with any known procedure.

An advantage of the first embodiment of the present invention is that for each of the fabrics 20, 22, 26, 28, the yarn count of the inner layer 30 (not counting the pile yarns 24) can be different from the yarn count of the outer layer 32. More specifically, for each of the fabrics 20, 22, 26, 28, and not counting the pile yarns 24, the inner layer 30 can have a different number of warp yarns per inch than the outer layer 32, and/or the inner layer can have a different number of weft yarns per inch than the outer layer. In some examples of the first embodiment, for each of the fabrics 20, 22, 26, 28, and not counting the pile yarns 24, examples of the ratio of the yarn count of the outer layer 32 to the yarn count of the inner layer 30 can be about 1:1, 1:2, 1:3, 1:4, 2:1, 3:1, 4:1 and so on. Even more specifically, for each of the fabrics 20, 22, 26, 28, and not counting the pile yarns 24, the ratio of the weft yarns 42 of the inner layer 30 to the weft yarns 36 of the outer layer 32, and/or the ratio of the warp yarns 40 of the inner layer to the warp yarns 34 of the outer layer, can be about 1:1, 1:2, 1:3, 1:4, 2:1, 3:1, 4:1 and so on.

In accordance with one exemplary version of the first embodiment of the present invention, for each of the fabrics 20, 22, 26, 28, and not counting the pile yarns 24, the ratio of the yarn count of the outer layer 32 to the yarn count of the inner layer 30 is about 1:1. Also for this exemplary version, and in the context of the fabric illustrated in FIG. 1 as having upper and lower connected fabrics 20, 22 woven face-to-face with pile yarns 24 interchanging therebetween, the fabric has about 286 warp yarns per inch and about 232 weft yarns per inch. The warp yarns referred to in the immediately preceding sentence include the pile yarns 24, warp yarns 34, and warp yarns 40, and the weft yarns referred to in the immediately preceding sentence include the weft yarns 36 and 42.

In accordance with another exemplary version of the first embodiment of the present invention, for each of the fabrics 20, 22, 26, 28, the yarn count of the outer layer 32 is greater than the yarn count of the inner layer 30 as a result of the inner layer having a lesser number of warp yarns per inch than the outer layer and/or the inner layer having a lesser number of weft yarns per inch than the outer layer, without counting the pile yarns 24. As a result, and for each of the fabrics 20, 22, 26, 28, the outer layer 32 can be very dense without requiring the inner layer 30 to be very dense. Accordingly, the advantages of having a dense outer layer 32 (e.g., wind resistance, capability of printing on without "bleed-through," etc.) can be achieved without having to also have a correspondingly dense inner layer 30, so that the amount of yarn included in the inner layer can be reduced, if desired, to control/reduce the cost of the fabric.

In accordance with the first embodiment of the present invention, a face-to-face or double velvet loom, namely a dobby or Jacquard velvet loom, or the like, can be used to weave the upper and lower connected fabrics 20, 22 face-to-face with the pile yarns 24 interchanging therebetween. In one example, the loom operates with three warp beams (not shown), with one of the beams supplying the warp yarns 40 of the inner layers 30, another of the beams supplying of the warp yarns 34 of the outer layers 32, and the other beam supplying the pile yarns 24. Other known beam arrangements can also be used. For example, two or more beams may supply the warp yarns 34 of the outer layers 32, such as if differently colored, differently sized, or different types of yarns are used for the warp yarns of the outer layers, such as for providing a woven fabric pattern.

While the connected fabrics 20, 22 are being woven, the weft yarns 36, 42 are respectively inserted laterally across with respect to the warp yarns 34, 40. In accordance with the first embodiment of the present invention, for each of the connected fabrics 20, 22, it is possible for the yarn(s) used for the weft yarns 42 of the inner layer 30 to be substantially different from the yarn(s) used for the weft yarns 36 of the outer layer 34. More specifically, the loom used to weave the connected fabrics 20, 22 is preferably a double rapier loom with a filling selector capable of selecting different types and/or colors and/or sizes of weft yarns. For example, there can be a set of four different types and/or colors and/or sizes of yarns from which the weft yarns 42 of the inner layers 30 and the weft yarns 36 of the outer layers 32 can be selected. The selections can be made so that for each fabric 20, 22, 26, 28, each layer 30, 32 can include four different types and/or colors and/or sizes of warp yarns. In addition, the selections can be made so that for each fabric 20, 22, 26, 28, all of the warp yarns 36 of the outer layer are different from all of the warp yarns 42 of the inner layer. For example, and advantageously, it is preferred to have the capability to select different types, thicknesses and colors of yarns for the weft yarns 36 of the outer layers 32 so that the outer layers, which are simultaneously formed with the inner layers 30, can be made from different kinds and/or colors and/or sizes of yarns as compared to the inner layers. For example, each outer layer 32 can include different colors, sizes and types of weft yarns 36 so that its nonpile surface 38 can define woven fabric patterns. That is, the filling selector of the loom can be used to get maximum flexibility in the filling insertion in each layer 30, 32.

Further regarding using the filling selector of the loom, in one version of the first embodiment of the present invention, the weft yarns 42 of the inner layer 30 remain in the inner layer such that they have no effect on the appearance of the nonpile surface 38. For such a version, the appearance of the weft yarns 42 of the inner layer 30 is not a concern, since they are at least substantially hidden from view. On the other hand, for another version of the first embodiment of the present invention, the weft yarns 42 of the inner layer 30 extend into the outer layer 32 where they interlace with the warp yarns 34 of the outer layer 32 for connecting the inner and outer layers, and so that the weft yarns of the inner layer at least partially define the nonpile surface 38 (e.g., see the weft yarns 342 of the inner layer 330 in FIGS. 6 and 7). In accordance with this latter version of the first embodiment, for each of the fabrics 20, 22, 26, 28, not only can the appearance of the nonpile surface 38 be controlled by using the filling selector of the loom to select from multiple different yarns to use for each insertion of the weft yarns 36 of the outer layer 32, the appearance of the nonpile surface can also be controlled by using the filling selector of the loom to select from multiple different yarns to use for each insertion of the weft yarns 42 of the inner layer 30. More specifically, preferably four different types and/or sizes and/or colors of yarns can be selected for use as the weft yarns which are part of a single nonpile surface 38.

In accordance with the first embodiment of the present invention, it is possible to use any kind of floating construction in the warp or weft direction, such as base weave, twill, satin or taffeta in both directions (warp and weft), in order to get advantageous nonpile surfaces 38. Any kind of yarn and combinations of yarns can be used such as to provide a plain, striped, plaid or a twill effect, or other effects, at the nonpile surfaces 38, without any relation to the pile surfaces 44. In accordance with the first embodiment of the present invention, the pile surfaces 44 can include dobby-like fabric patterns or jacquard fabric patterns, or other types of patterns. The pile fabrics 26, 28 can also be made stretchable, preferably by using elastic yarns for the weft yarns 36, 42.

FIG. 3 schematically illustrates upper and lower connected fabrics 120, 122 woven face-to-face with pile yarns 124 interchanging therebetween, and FIG. 4 schematically illustrates upper and lower pile fabrics 126, 128 that were partially formed by cutting the pile yarns to separate the two fabrics, all in accordance with a second embodiment of the present invention. The upper and lower connected fabrics 120, 122 and the pile fabrics 126, 128 of the second embodiment, including versions thereof, are respectively like the fabrics 20, 22, 26, 28 (FIGS. 1 and 2) of the first embodiment, including versions thereof, except for variations noted and variations that will be apparent to those of ordinary skill in the art in view of this disclosure. Accordingly, reference characters for items of the second embodiment that are respectively at least generally like items of the first embodiment are incremented by a hundred.

All of the embodiments of the present invention are preferably like the first embodiment of the present invention in that for each of the fabrics of the present invention, preferably the yarn count of the inner layer (not counting the pile yarns) can be different from the yarn count of the outer layer. For example, and in accordance with at least one version of the second embodiment of the present invention, for each of the fabrics 120, 122, 126, 128, the yarn count of the outer layer 132 is greater than the yarn count of the inner layer 130, as a result of the inner layer having a lesser number of warp yarns per inch than the outer layer, and/or the inner layer having a lesser number of weft yarns per inch than the outer layer, without counting the pile yarns 124. Referring to FIGS. 3 and 4 more specifically, they illustrate that for each of the fabrics 120, 122, 126, 128, the weft yarns 136 of the outer layer 132 have a greater count than the weft yarns 142 of the inner layer 130. More specifically, FIGS. 3 and 4 illustrate that the ratio of the weft yarns 136 of the outer layer 132 to the weft yarns 142 of the inner layer 130 is 2:1. FIGS. 3 and 4 also illustrate that the pile yarns 124 are tied into the inner layers 130 by a multiple W-like weave, which was discussed previously. That is, multiple W-like weaving of the pile yarns 124 secures them into the inner layers 130, and as illustrated in FIGS. 3 and 4, the multiple W-like weaves are offset. The result of such offset weaving of the pile yarns 124 can be a dobby or jacquard pattern velvet at the pile surfaces 144.

In accordance with one exemplary version of the second embodiment of the present invention: each pile yarn 124 is a single polyester yarn (i.e., a yarn that is not plied) that is about 300 denier; each warp yarn 134 is a single nylon yarn that is about 150 denier; each weft yarn 136 is a single nylon yarn that is about 200 denier; each warp yarn 140 is a single polyester yarn that is about 300 denier; each weft yarn 142 is a single polyester yarn that is about 400 denier; and for each of the fabrics 120, 122, 126, 128, and not counting the pile yarns 124, the ratio of the yarn count of the outer layer 132 to the yarn count of the inner layer 130 is about 2:1. Also for this exemplary version, and in the context of the fabric illustrated in FIG. 3 as having upper and lower connected fabrics 120, 122 woven face-to-face with pile yarns 124 interchanging therebetween, the fabric has about 286 warp yarns per inch. The warp yarns referred to in the immediately preceding sentence include the pile yarns 124, warp yarns 134, and warp yarns 140.

FIG. 5 schematically illustrates pile fabrics 226, 228 that are face-to-face and were partially formed by cutting pile yarns 224 that were connecting connected fabrics that were woven face-to-face with the pile yarns interchanging therebetween, in accordance with a third embodiment of the present invention. The fabrics of the third embodiment, including versions thereof, are respectively like the fabrics 20, 22, 26, 28 (FIGS. 1 and 2) of the first embodiment, including versions thereof, except for variations noted and variations that will be apparent to those of ordinary skill in the art in view of this disclosure. Accordingly, reference characters for items of the third embodiment that are respectively at least generally like items of the first embodiment are incremented by two hundred.

In accordance with the third embodiment of the present invention, the pile yarns 224 are tied into the inner layers 230 by a W-like weave, which was discussed previously. That is, W-like weaving of the pile yarns 224 secures them into the inner layers 230, and as illustrated in FIG. 5, the W-like weaves are offset. The result of such offset weaving of the pile yarns 224 can be a dobby or jacquard pattern velvet at the pile surfaces 244. As schematically illustrated in FIG. 5, the nonpile surfaces 238 (e.g., the warp yarns 234 and the weft yarns 236 of the outer layer 232) have been napped. Nap can be raised at the nonpile surfaces of the other embodiments of the present invention, or the nap can be omitted.

FIGS. 1–5 are schematic elevational views of longitudinal edges of respective exemplary fabrics of the first through third embodiments of the present invention. In contrast, FIGS. 6 and 7 can be characterized as being schematic elevational views of lateral edges of respective exemplary fabrics of the first through third embodiments of the present invention. In this regard, the longitudinal and lateral directions are perpendicular to one another. Other exemplary fabrics of the first through third embodiments are different than shown in FIGS. 6 and 7, such as by not having weft yarns of the inner layer extend into the outer layer where they are interlaced with warp yarns of the outer layer.

FIGS. 6 and 7 can alternatively be characterized as being elevational views of lateral edges of fabrics 320, 322, 326, 328 in accordance with a fourth embodiment of the present invention. The fabrics 320, 322, 326, 328 of the fourth embodiment, including versions thereof, are respectively like the fabrics 120, 122, 126, 128 (FIGS. 3 and 4) of the second embodiment, including versions thereof, except for variations noted and variations that will be apparent to those of ordinary skill in the art in view of this disclosure. Accordingly, reference characters for items of the fourth embodiment that are respectively at least generally like items of the second embodiment are incremented by two hundred.

In accordance with the fourth embodiment of the present invention, for each of the fabrics 320, 322, 326, 328, the yarn count of the outer layer 332 is greater than the yarn count of the inner layer 330 as a result of the inner layer having a lesser number of warp yarns per inch than the outer layer, and/or the inner layer having a lesser number of weft yarns per inch than the outer layer, without counting the pile yarns 324. Referring to FIGS. 6 and 7 more specifically, they illustrate that for each of the fabrics 320, 322, 326, 328, the warp yarns 334 of the outer layer 332 have a greater count than the warp yarns 340 of the inner layer 330. More specifically, FIGS. 6 and 7 illustrate that the ratio of the warp yarns 334 of the outer layer 332 to the warp yarns 340 of the inner layer 330 is 2:1.

FIGS. 6 and 7 also illustrate that for each fabric 320, 322, 326, 328, at least some of the yarns of at least one of the layers 320, 322 interlace with at least some of the yarns of the other layer 330, 332 so that the outer and inner layers 320, 322 are connected to one another. More specifically, and as illustrated in FIGS. 6 and 7 for each fabric 320, 322, 326, 328, the weft yarns 342 of the inner layer 330 extend into the outer layer 332 where they interlace with the warp yarns 334 of the outer layer 332 so that the outer and inner layers are connected to one another. As a result and as illustrated in FIGS. 6 and 7, for each of the fabrics 320, 322, 326, 328, the weft yarns 342 of the inner layer 330 at least partially define the nonpile surface 338, which advantageously contributes to a relatively high yarn count at the nonpile surface. Nonetheless, the pile yarns 324 are tied into the inner layers 330 such that they do not extend into the outer layers 332. Indeed and for each fabric 320, 322, 326, 328, the pile yarns 324 preferably extend away from the outer layer 332.

As mentioned above, fabrics of the first through fourth embodiments of the present invention can incorporate different colors, sizes and types of yarns that are arranged so that the nonpile surfaces 38, 138, 238, 338 can define woven fabric patterns. Likewise the nonpile surfaces 38, 138, 238, 338 can define woven fabric patterns that are derived solely from the weave (e.g., twill, satin, etc.) without requiring different colors, sizes and types of yarns in the outer layers. In accordance with preferred examples of each of the first through the fourth embodiments of the present invention, the woven fabric patterns can be simultaneously formed in the nonpile surfaces of the connected fabrics, with the fabric patterns being at least substantially alike yet unparallel prior to cutting/separating the connected fabrics from one another to form the pile fabrics. Advantageously, for the resulting pile fabrics that were originally connected, they can be placed in a predetermined overlapping configuration so that simultaneously: the pile fabrics are parallel, the pile surface of one of the pile fabrics is in opposing face-to-face relation with the nonpile surface of the other of the pile fabrics, and the fabric patterns of the nonpile surfaces of the pile fabrics are at least substantially parallel. This and related preferred features of each of the first through the fourth embodiments of the present invention will be described in greater detail below, with the description being in the context of a fifth embodiment of the present invention in an effort to clarify this disclosure. Reference characters for items of the fifth embodiment that are respectively at least generally like items of the first embodiment are incremented by four hundred.

FIG. 8 is a schematic top plan view of a portion of connected fabrics 420, 422 exiting a weaving area 50 of a loom in which they are simultaneously woven. The lower connected fabric 422 is hidden from view below the upper connected fabric 420 in FIG. 8. The nonpile surface 438 of the upper connected fabric 420 includes a fabric pattern 52 that is schematically illustrated in FIG. 8. The nonpile surface 438 of the lower connected fabric 422 also includes a fabric pattern 54, and broken lines in FIG. 8 illustrate the fabric pattern 54 of the nonpile surface of the lower connected fabric because it is hidden from view. In accordance with the fifth embodiment of the present invention, the fabric patterns 52, 54 of the connected fabrics 420, 422 are at least substantially alike, yet they are not parallel, and most preferably they are perpendicular, as illustrated FIG. 8. As also illustrated in FIG. 8, the fabric patterns 52, 54 extend obliquely with respect to the longitudinal (i.e., lengthwise) directions of the fabrics 420, 422, and the longitudinal directions of the fabrics are parallel.

FIG. 9 schematically illustrates a cutter 56 that is cutting the pile yarns 424 interlaced between the connected fabrics 420, 422, with the resulting pile fabrics 426, 428 being formed into upper and lower rolls 58, 60, in accordance with the fifth embodiment of the present invention. The cutter 56 can be any cutter that is known in the art and suitable for forming the pile fabrics 426, 428 from the connected fabrics 420, 422. FIG. 10 is an enlarged, schematic plan view of the nonpile surface 438 of the upper pile fabric 426, which shows the fabric pattern 52 in greater detail, in accordance with a first version of the fifth embodiment of the present invention. A schematic plan view of the nonpile surface 438 of the lower pile fabric 428 is identical to that which is illustrated in FIG. 10, in accordance with the first version of the fifth embodiment of the present invention. FIG. 11 is a schematic plan view of the pile surface 444 of the upper pile fabric 426, and a schematic plan view of the pile surface 444 of the lower pile fabric 428 is identical to that which is illustrated in FIG. 11, in accordance with the first version of the fifth embodiment of the present invention.

FIGS. 12 and 13 schematically illustrate the pile fabrics 426, 428 being unrolled one on top of the other, so that the pile surface 444 of the upper pile fabric 426 is in opposing face-to-face relation with the nonpile surface 438 of the lower pile fabric 428, and the fabric patterns 52, 54 of the pile fabrics are at least substantially parallel. Referring to FIG. 13, and in accordance with one example of the fifth embodiment of the present invention, the end edge 62 of the upper pile fabric 426 is moved toward the end edge 64 of the lower pile fabric 428 to achieve the predetermined overlapping configuration in which the fabric patterns 52, 54 are substantially parallel and aligned. As best understood with reference to FIG. 13, and in accordance with the illustrated example of the fifth embodiment of the present invention, the predetermined overlapping configuration is achieved while the pile surface 444 of the upper pile fabric 426 is in opposing face-to-face relation with the nonpile surface 438 of the lower pile fabric 428 and the end edges 62, 64 and the side edges of the fabrics 426, 428 are respectively aligned with one another. Preferably the fabric patterns 52, 54 can be substantially parallel and aligned to provide the predetermined overlapping configuration without requiring the edges of the fabrics to be aligned.

It is advantageous that the fabric patterns 52, 54 can be substantially parallel and aligned while the pile surface 444 of the upper pile fabric 426 is in opposing face-to-face relation with the nonpile surface 438 of the lower pile fabric 428, because this configuration allows both fabric patterns to be conveniently simultaneously seen for alignment purposes. It is advantageous in some situations to have fabric patterns parallel and aligned when simultaneously cutting through multiple fabrics according to a cutting pattern. For example, FIG. 14 illustrates the pile surface 444 of the upper pile fabric 426 in opposing face-to-face relation with the nonpile surface 438 of the lower pile fabric 428 with the end edges 62, 64 and side edges of the pile fabrics aligned so that the fabric patterns 52, 54 (see FIG. 13) are substantially parallel and aligned with one another, in accordance with one example of the fifth embodiment of the present invention. FIG. 14 also illustrates using a cutting mechanism 66 to simultaneously cut through both of the pile fabrics 426, 428 according to an exemplary predetermined cutting pattern 68, which is illustrated by broken lines. The cutting mechanism 66 can be any cutting mechanism that is known in the art and suitable for cutting the layered pile fabrics 426, 428 according to a cutting pattern, and the cutting pattern 68 can be a wide variety of different cutting patterns. The pile fabrics of the present invention can acceptably have a width for cutting (i.e., a width that does not include the selvage) of about 59 inches, and a weight of about 18 ounces per linear yard. That is, a piece of the pile fabric of the present invention that is about 59 inches wide and that does not include the selvage, and that is about a yard long, can weigh about 18 ounces.

The fabrics of the present invention can be made from a wide variety of types, sizes and colors of yarns, can have a wide variety of different numbers of yarns per inch, and can have a wide variety of different weights, all depending upon how the fabrics will be used; and a very wide variety of uses are contemplated, such as, but not limited to, for clothing to be worn outdoors, and heat and flame protective clothing. For heat and flame protective clothing, and clothing for use outdoors, it is preferred for the clothing to be made or worn so that the pile surface 44 faces the body of the person wearing the garment and the nonpile surface 38 faces away from their body. In this configuration, the pile surface 44 helps to trap and hold air at positions adjacent the body, and in this way a protective layer of air is trapped adjacent the body and works synergistically with the fabric of the present invention to provide the desired result. Regarding the fabrics of the present invention that provide heat and flame protection, fire retardant coating(s) can be applied to the pile fabrics of the present invention and/or the pile fabrics of the present invention can be made of fire retardant yarns, such as fire retardant yarns sold under the brand name of Nomex. In some cases, all of the yarns of the pile fabrics of the present invention are Nomex brand yarns. For pile fabrics of the present invention that are to be used in outdoor wear, it can be preferred for the yarns of the outer layer of the fabric to be nylon, and the pile yarns to be micro-denier polyester. The yarns of the inner layer may also be micro-denier polyester. A wide variety of other yarn selections are also within the scope of the present invention. That is, the fabrics of the present invention can be made from any types of natural or synthetic yarns, or the like.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A pile fabric, comprising:

first and second layers of the fabric, wherein the first layer at least partially defines a nonpile surface of the pile fabric, the first layer includes warp and weft yarns that are woven together, the second layer includes warp and weft yarns that are woven together, and at least some of the yarns of at least one of the layers interlace with at least some of the yarns of the other layer so that the first and second layers are connected to one another; and cut pile yarns woven into the second layer and extending away from the first layer so that the pile yarns at least substantially define a pile surface of the pile fabric, wherein, and not counting the pile yarns, the first layer has a higher yarn count than the second layer.

2. A pile fabric according to claim 1, wherein the nonpile surface is substantially flat.

3. A pile fabric according to claim 1, wherein the first and second layers are adjacent to one another.

4. A pile fabric according to claim 1, wherein at least some of the warp yarns of the first layer extend into the second layer and interlace with at least some of the weft yarns of the second layer so that the first and second layers are connected to one another.

5. A pile fabric according to claim 1, wherein the pile yarns are warp yarns.

6. A pile fabric according to claim 1, wherein none of the pile yarns of the pile fabric are present in the first layer.

7. A pile fabric according to claim 1, wherein the first layer has a higher count of weft yarns than the second layer.

8. A pile fabric according to claim 1, wherein at least some of the weft yarns of the second layer extend into the first layer and interlace with at least some of the warp yarns of the first layer so that the first and second layers are connected to one another.

9. A pile fabric according to claim 8, wherein at least some of the weft yarns of the second layer at least partially define the nonpile surface.

10. A pile fabric according to claim 1, wherein, and not counting the pile yarns, the first layer has a higher count of warp yarns than the second layer.

11. A pile fabric according to claim 10, wherein, and not counting the pile yarns, the first layer has a higher count of weft yarns than the second layer.

12. A pile fabric according to claim 1, wherein for each cut pile yarn, the cut pile yarn extends from the pile surface, partially around/behind one weft yarn of the second layer, and then back to the pile surface.

13. A pile fabric according to claim 1, wherein for each cut pile yarn, the cut pile yarn extends from the pile surface, partially around/behind two adjacent weft yarns of the second layer, and then back to the pile surface.

14. A pile fabric according to claim 1, wherein for each cut pile yarn, the cut pile yarn extends:

from the pile surface, partially around/behind a first weft yarn of the second layer, over a second weft yarn of the second layer, wherein the second weft yarn is adjacent the first weft yarn, partially around/behind a third weft yarn of the second layer, wherein the third weft yarn is adjacent the second weft yarn, and then back to the pile surface.

15. A pile fabric according to claim 1, wherein for each cut pile yarn, the cut pile yarn extends:

from the pile surface, partially around/behind a first weft yarn of the second layer, over a second weft yarn of the second layer, wherein the second weft yarn is adjacent the first weft yarn, behind a third weft yarn of the second layer, wherein the third weft yarn is adjacent the second weft yarn, over a fourth weft yarn of the second layer, wherein the fourth weft yarn is adjacent the third weft yarn, and behind a fifth weft yarn of the second layer, wherein the fifth weft yarn is adjacent the fourth weft yarn.

16. A method of forming pile fabrics, comprising:

simultaneously weaving first and second fabrics, including:

for each of the first and second fabrics: weaving first and second layers of the fabric so that the first layer at least partially defines a nonpile surface of the fabric, the first layer includes warp and weft yarns that are woven together, the second layer includes warp and weft yarns that are woven together, and at least some of the yarns of at least one of the layers interlace with at least some of the yarns of the other layer so that the first and second layers are connected to one another, orienting the second layer of the first fabric in opposing face-to-face relation with the second layer of the second fabric, and connecting the first and second fabrics including weaving pile yarns into the second layers of the first and second fabrics while the second layers of the first and second fabrics are in opposing face-to-face relation with one another, so that the pile yarns extend between the second layers of the first and second fabrics, wherein, and not counting the pile yarns, for each of the first and second fabrics, the first layer has a higher yarn count than the second layer; and then cutting the pile yarns to separate the first and second fabrics from one another so that each of the first and second fabrics respectfully becomes a pile fabric.

17. A method according to claim 16, wherein for each of the first and second fabrics, the weaving the first and second layers of the fabric includes interlacing at least some of the warp yarns of the first layer with at least some of the weft yarns of the second layer so that the first and second layers are connected to one another.

18. A method according to claim 16, wherein for each of the first and second fabrics, the weaving the first and second layers of the fabric includes making the first and second layers adjacent to one another.

19. A method according to claim 16, wherein weaving the pile yarns includes keeping all of the pile yarns out of the first layers of the first and second fabrics.

20. A method according to claim 16, wherein for each of the first and second fabrics, and not counting the pile yarns, the first layer has a higher count of warp yarns than the second layer.

21. A method according to claim 16, wherein for each of the first and second fabrics, the first layer has a higher count of weft yarns than the second layer.

22. A method according to claim 21, wherein for each of the first and second fabrics, and not counting the pile yarns, the first layer has a higher count of warp yarns than the second layer.

23. A method according to claim 16, wherein the simultaneously weaving includes weaving an oblique pattern in the first fabric and weaving an oblique pattern in the second fabric, with the patterns being at least substantially alike yet unparallel, at least prior to the cutting.

* * * * *